United States Patent [19]

Staelgraeve

[11] 4,444,354

[45] Apr. 24, 1984

[54] TRAY WITH TELESCOPING COVER FORMED FROM IDENTICAL BLANKS

[76] Inventor: Daniel H. Staelgraeve, 435 Ruff Dr., Monroe, Mich. 48161

[21] Appl. No.: 397,323

[22] Filed: Jul. 12, 1982

[51] Int. Cl.[3] ..... B65D 5/20; G09F 23/10

[52] U.S. Cl. ..... 229/23 BT; 40/312; 40/539; 46/1 L; 206/459; 229/32

[58] Field of Search ..... 229/23 BT, 23 R, 32, 229/35, 73, 87 R; 206/459; 40/312, 313, 539; 46/1 L, 21; D9/430–433, 332, 333

[56] References Cited

U.S. PATENT DOCUMENTS

| | | | |
|---|---|---|---|
| 895,520 | 8/1908 | Virkus | 229/73 |
| 1,202,373 | 10/1916 | Frank | 229/73 |
| 1,892,983 | 1/1933 | Holmer | 229/32 |
| 2,011,703 | 8/1935 | Barker | 229/87 |
| 3,027,062 | 3/1962 | Huss et al. | 229/23 R |
| 3,469,761 | 9/1969 | Howell | 229/32 |
| 3,987,897 | 10/1976 | Smith | 206/459 X |
| 4,083,563 | 4/1978 | Drohomirecky et al. | 46/1 L |
| 4,217,984 | 8/1980 | Magnuson | 229/23 BT X |
| 4,362,265 | 12/1982 | Williams | 229/32 |

FOREIGN PATENT DOCUMENTS

| | | | |
|---|---|---|---|
| 79883 | 1/1963 | France | 229/23 BT |
| 2239386 | 2/1975 | France | 206/459 |

*Primary Examiner*—William Price
*Assistant Examiner*—Gary E. Elkins
*Attorney, Agent, or Firm*—Stephenson & Boller

[57] ABSTRACT

A package component comprises a main end wall and sidewall segments joining with the main end wall. A flap integrally joining with each sidewall segment overlaps with and is secured to an immediately sidewall segment. The package component may be fabricated as either an inner half or an outer half of two telescopic components and the amount of flap overlap determines whether the component is an inner or outer one. The main end wall areas of the inner and outer components are identical.

21 Claims, 12 Drawing Figures

TRAY WITH TELESCOPING COVER FORMED FROM IDENTICAL BLANKS

BACKGROUND AND SUMMARY OF THE INVENTION

This invention relates to packaging and is particularly concerned with packaging in which package components are fabricated from flat blanks, such as paperboard blanks.

In many instances packaging is manufactured for a specific product which is to be packaged. In these situations the packaging is generally unique to the product although it is possible that it could be used for other products. Heretofore packaging comprising telescoping package halves has usually involved unique inner and outer telescoping halves. This means that different size blankets must be cut for each and that suitable inventories of each must be stocked in order to meet the packaging needs for the products involved.

It is heretofore also been recognized that manufacturing and inventory requirements can be simplified by using a common blank to form both telescopic halves of a package. An example of this is disclosed in U.S. Pat. No. 3,469,761.

The blank of that patent has two sets of fold, or score, lines. Folds are made along one set of score lines in one blank for one half of the package, and the other half of the package is fabricated by folding another blank along the other set of score lines. The respective sets of score lines define two different main rectangular areas of the blank, which main rectangular areas become the end walls (i.e. the top and bottom walls) of the package. Each blank comprises four sidewall segment areas along the sides of the blank and four flap areas at each of the four corners of the blank. Rather than each flap area joining to a corresponding one of the sidewall segment areas, the flap areas are arranged in pairs with the two flap areas of each pair joining to a corresponding one of a pair of opposite sidewall areas at the opposite ends of the sidewall area. The other pair of opposite sidewall areas are separated from the flap areas by slots.

When one of the two package halves is formed from one of these blanks, the side segment areas are folded out of the plane of the main area along the appropriate set of score lines, and the flap areas are folded relative to the sidewall area to which they join so as to overlap the respective immediately adjacent sidewall areas. A package component is thereby fabricated in which the main rectangular area of the blank has become the end (i.e. top or bottom) wall, the sidewall segment areas have become the sidewall, and the flap areas have become the four corners of the sidewall. The other package half is fabricated in an analogous manner using the other set of score lines. When the two halves are telescoped together, each corner of the telescoped package has a construction in which along one side there are four thicknesses of material while there are only two thicknesses along the other side.

The present invention is directed to a new and improved package construction in which a common blank is used to form both inner and outer telescoping package halves but which does not require separate sets of fold, or score, lines which are selectively utilized depending upon whether an inner or an outer package half is to be formed from the blank. Rather the invention provides a construction whereby the fold lines of the sidewall segment areas about the main end wall area are the same regardless of whether an inner or outer telescopic half is to be fabricated, whereby the main end wall area is the same for both inner and outer halves. For a rectangular shaped main end wall area the blank has four corresponding sidewall area segments each of which integrally joins with the main end wall area along one of the four sides of the main end wall area. The blank is provided with flap areas at the intersection of extensions of the sidewall segment areas (i.e. at the four corners of the blank) so that each flap area has two sidewall segment areas immediately adjacent to it. Each sidewall area integrally joins with a corresponding flap area, and each flap area is separated from the other immediately adjacent sidewall segment area by a cut, which may take the form of a V-notch. The fabrication of the blank into either an inner telescoping half or an outer telescoping half is determined by the amount of overlap of each flap area with the other immediately adjacent sidewall segment area when the sidewall and flap area are folded into their fabricated positions. By increasing the amount of overlap of a flap area with the other immediately adjacent sidewall area segment the four corners of the free edge of the package half are increasingly drawn toward the interior. An inner telescoping half is formed by drawing the four corners of the free edge more inwardly than is the case for an outer telescoping half. In other words the outer telescoping half has the four corners of the free edge drawn less inwardly than the corresponding four corners of the free edge of an inner telescoping half, yet both halves have congruent main end wall areas. A packaging component formed from such a blank may be used either as one half of a telescoping package or it may be used by itself as a tray.

The invention possesses even further advantages. Increased corner strength is also provided, particularly for two telescoping halves whereby at each corner of the telescoping halves each side comprises three thicknesses of material. Where the material from which the blank is made is in the form of corrugated paperboard the direction of the corrugations can be used to advantage. By making the corrguations run in particular directions in the assembled packaging increased vertical stacking strength and/or increased resistance to bulging of the sidewalls can result.

Still another feature involves the use of indicia on the blank. Different indicia can be applied to opposite faces of the blank and the manner in which the blank is fabricated into packaging can provide for the indicia to be on either the exterior or the interior of the package. Thus for telescoping package halves embodying the invention, it is possible for a single inventory supply of blanks having such indicia to be used to fabricate both inner and outer telescoping package halves for use in packaging different types of products and providing accurate identification on the package exterior.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
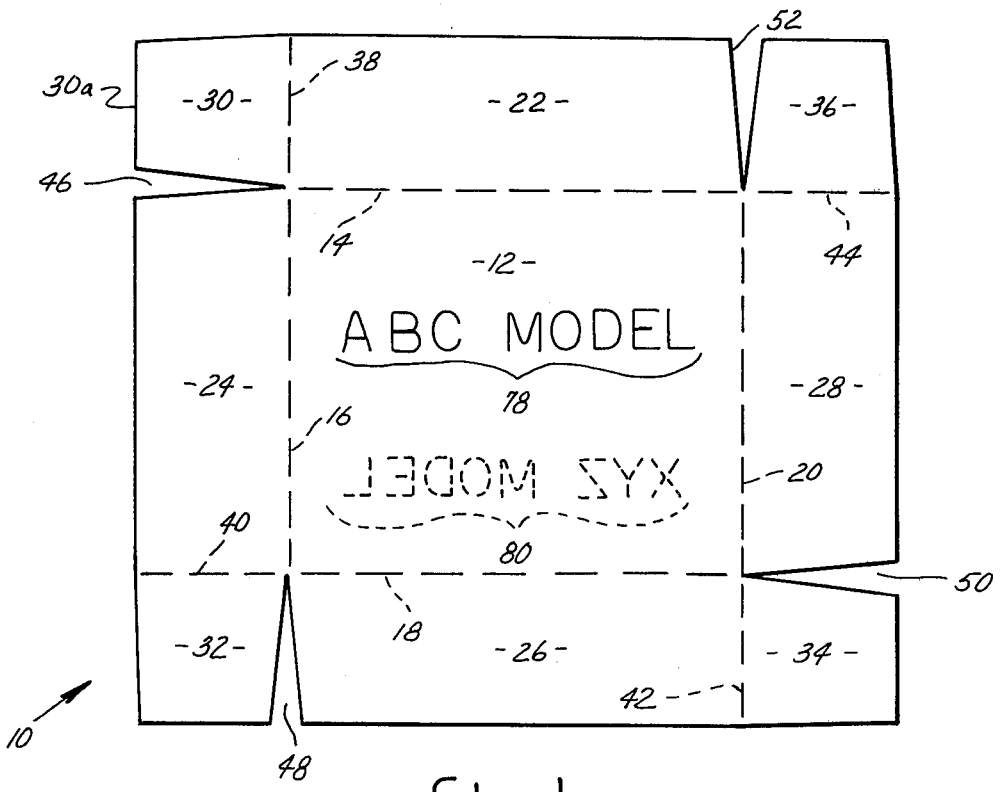
FIG. 1 is a plan view of a package blank embodying principles of the present invention.

FIG. 1 illustrates a blank 10 embodying principles of the present invention. Blank 10 has a generally rectangular shape for use in fabricating a rectangular shaped packaging component. Blank 10 comprises a rectangular main wall area 12 which in the drawing figure is bounded by the four broken lines 14, 16, 18 and 20 respectively. The four broken lines define lines of folding when the blank is formed into the packaging component and depending upon the nature of the blank material these lines of folding may be impressed into the blank as scores. However, it will be understood that principles of the invention may be applied to blanks which do not have scores or other pre-formed lines of folding.

Integrally joining with main wall area 12 are four sidewall area segments 22, 24, 26 and 28 respectively. Each of these four sidewall area segments may be considered as generally rectangular in shape, and one side of each joins to the main wall area 12 along a corresponding one of the lines 14, 16, 18 and 20.

If each of the sidewall area segments were extended lengthwise along imaginary lines of extension there would be four such intersections at the four corners of the blank. The blank includes flap areas 30, 32, 34, and 36 respectively at those four intersections. Each sidewall 22, 24, 26 and 28 integrally joins with a corresponding flap area 30, 32, 34 and 36. The joinders are along broken lines 38, 40, 42 and 44 respectively and each of these lines is coincident with a side edge of the corresponding sidewall segment area 22, 24, 26 and 28 which is perpendicular to the corresponding line of joinder of the sidewall segment area with the main wall area 12. FIG. 1 illustrates each flap projecting away from its corresponding sidewall area segment in the same sense, i.e. in the counterclockwise sense.

Thus each flap area integrally joins one of its two immediately adjacent sidewall segment areas while it is separated from the other of the two immediately adjacent sidewall segment areas by a cut. The cuts are identified in FIG. 1 by the respective numerals 46, 48, 50 and 52. The illustrated shape of the cuts 46, 48, 50 and 52 shows them to be of V-shape. Other shapes, however, are contemplated within the scope of the invention. The V-shape of the cuts which are illustrated results in each side of the V being at a slight angle to the corresponding line 14, 16, 18 and 20. Each flap area is illustrated to be of a trapezoidal shape in that the distal edge of the flap area (for example 30*a* of flap area 30) is parallel to its line of joinder (38) to the corresponding sidewall segment area while the other two sides are non-parallel, one of these other two sides being one side of the corresponding V-shaped cut. Hence each flap is of a tapered shape comprising a taper which narrows in the direction away from the line of joinder of the flap to the corresponding side segment area. Once again this flap area construction is representative of the preferred embodiment and it is to be understood that other shapes are contemplated within the scope of the invention.

Figure 2:
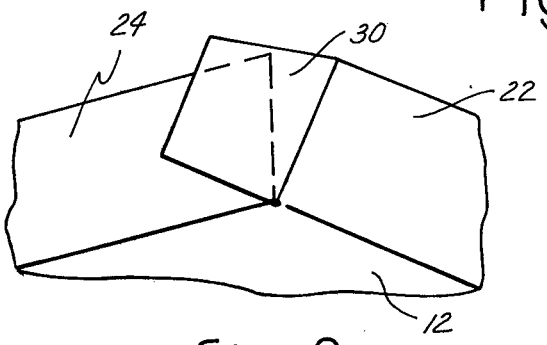
FIG. 2 is a fragmentary perspective view illustrating a step in the procedure for forming the blank of FIG. 1 into a packaging component.

FIG. 2 illustrates a step in one procedure for fabricating blank 10 into a packaging component. For example the illustrated fabrication procedure involves the four side segment areas 22, 24, 26 and 28 being folded relative to main area 12 upwardly out of the plane of the drawing figure about their respective fold lines 14, 16, 18 and 20 and with each flap area 30, 32, 34 and 36 being folded inwardly along the respective fold line 38, 40, 42 and 44 with the flaps thus being caused to overlap the immediately adjacent side segments. FIG. 2 illustrates this for the upper left hand corner of the blank of FIG. 1. The illustrated procedure has the flap area 30 folded inwardly so as to overlie the sidewall segment area 24 on the interior. The remaining flap areas are similarly folded so that all flap areas are on the interior. In this way the exterior appearance will not reveal the edges of the flap areas when the component is telescoped with a similar mating one which has been fabricated into the other of two telescoping halves. However, it should be recognized that it would be possible to fabricate a packaging component with the flaps overlapping the immediately adjacent side segment on the exterior rather than on the interior, or even with some on the interior and some on the exterior.

Figure 3:
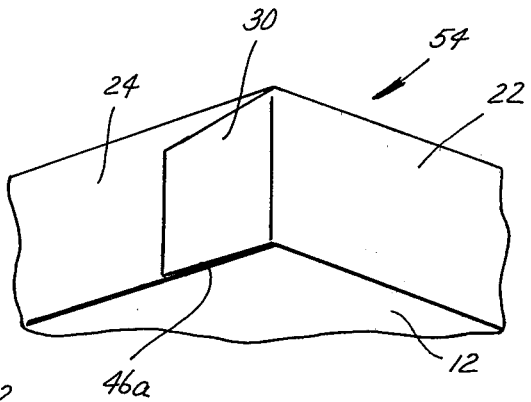
FIG. 3 is a view similar to FIG. 2 illustrating a completed fabrication.
Figure 4:
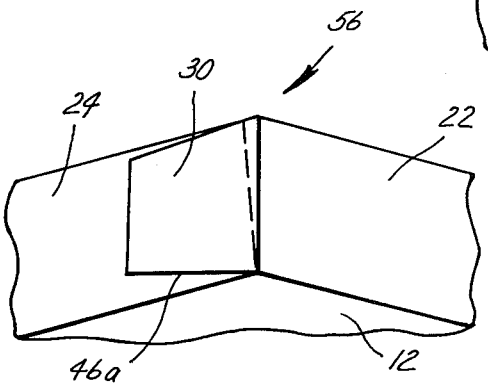
FIG. 4 is a view similar to FIG. 2 illustrating another completed fabrication different from that of FIG. 3.

FIG. 2 illustrates an intermediate step in the fabrication process; generally the fabrication process will be such that each sidewall segment area is finally brought into a condition of general perpendicularity to the main end wall area 12. Such conditions are illustrated in FIGS. 3 and 4 for two different packaging components. The exact amount of folding of a sidewall segment area about its line of joinder with the main wall area is important when the fabricated packaging component is to be used as a particular half, either an inner half or an outer half, in telescoping packaging.

FIG. 3 illustrates the construction of an inner telescoping half 54. With this construction the sidewall segment area 22 is shown to be virtually perpendicular to the main wall area 12 so that there is a maximum amount of overlap of flap area 30 with the immediately adjacent sidewall segment area 24. It will be further observed in FIG. 3 that the cut 46 has the edge thereof 46*a* which is along flap 30 disposed very close to main wall area 12. The directly opposite side edge of the flap 30 has a greater separation from the free edge of the sidewall segment area 24. Thus these side edges may be used as guides for fabricating a blank into a particular packaging component. In other words the edge 46a may be brought almost onto main area 12 for a half 54; the opposite edge may be brought almost into alignment with the free lengthwise edge of side 24 for a half 56, as shown in FIG. 4.

FIG. 4 illustrates the fabrication of an outer telescoping half 56 which will telescope onto the inner telescoping half 54. In FIG. 4 the side edge 46a of the V-shaped cut 46 is further separated from main wall area than was the case in FIG. 3, and the directly opposite side edge is shown to be much closer to the free edge of the side segment area 24 than was the case in FIG. 3.

Figure 5:
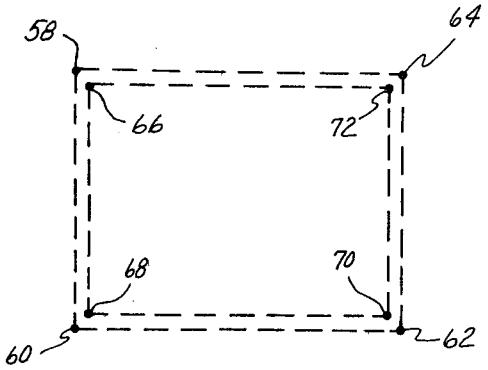
FIG. 5 is a schematic diagram useful in explaining principles of the invention.

Thus for an inner telescoping package half the construction of the four corners is represented by that shown in FIG. 3 while for an outer telescoping half the construction for each of the four corners is represented by the showing of FIG. 4. FIG. 5 schematically illustrates the effect. The reference numeral 58, 60, 62 and 64 represent the four corner points of the free edge of the outer telescoping half. The points identified by the numerals 66, 68, 70 and 72 represent the four corner points of the free edge of the inner telescoping half. Thus one will understand that the amount of overlap of each flap area with the immediately adjacent side segment area determines the location of the corresponding corner point of the free edge. In this way the same blank can be used for fabrication of both inner and outer telescoping components. Because the main wall areas 12 which form the end walls (i.e. top and bottom walls) are exactly the same size and shape, the sidewall segments of one half will not be truly parallel with the corresponding sidewall segments of the other half, when the two halves are telescoped together. However, where the blank typically comprises a paperboard material there will be a certain flexibility in the sidewalls which readily adapts to this theoretical non-parallelism whereby the two halves can in fact telescope together to form a closed package. Furthermore, partial as well as full telescopic engagements are possible. Depending upon the particular packaging requirements the relative amounts of flap overlap and hence setting of the corresponding sidewalls may be subject to adjustment in order to optimize fit.

Figure 6:
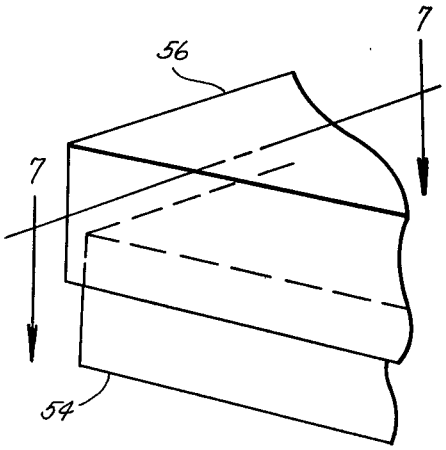
FIG. 6 is a fragmentary perspective view of telescopically engaged packaging halves embodying principles of the invention.
Figure 7:
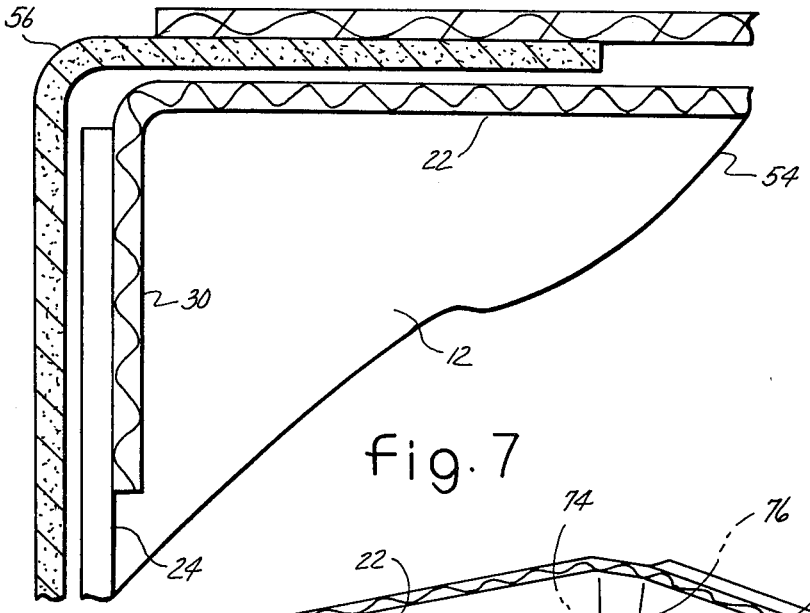
FIG. 7 is a fragmentary sectional view taken in the direction of arrows 7—7 in FIG. 6 and enlarged.

FIG. 6 illustrates a construction which shows two telescopically engaged halves, the upper half being an outer half 56 and the lower half being an inner half 54. The resultant construction has an improved corner strength in that at each of the four corners both sides of the package comprise three thicknesses of material. This can be best seen in FIG. 7 which illustrates a cross sectional view through one corner of the telescoped halves. The example of FIG. 7 also shows the packaging to be fabricated from corrugated paperboard, and such a construction provides increased vertical stacking strength and increased resistance to bulging. In this regard it will be observed that at each corner one side comprises two of the three thicknesses having the corrugations vertical and the third having the corrugations horizontal, while the other side comprises two of the three thickness having the corrugations horizontal and the third having the corrugations vertical. Although the flaps are shown to be on the interiors of their respective halves, increased bulging resistance may be obtained by having them on the respective exteriors.

Figure 8:
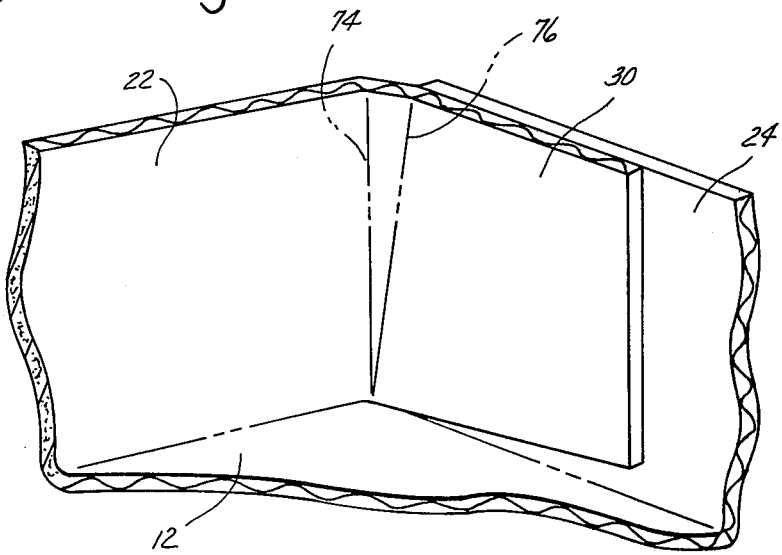
FIG. 8 is a fragmentary perspective view similar to FIG. 4 illustrating another embodiment.

FIG. 8 illustrates the construction of an alternate embodiment. In this alternate embodiment the use of a thicker material is illustrated and in order to facilitate fabrication it may be useful to provide two separate non-parallel score lines 74, 76 for each flap fold as indicated. These score lines are intersecting and allow a better formation of the corner where such thicker material is used. The score 74 is preferably virtually perpendicular to the main end wall area 12. This embodiment also differs from that of FIGS. 2, 3, 4 and 7 in that the packaging component has been formed by folding the side segment areas downwardly relative to the plane of FIG. 1 whereby when viewed from the interior of the component the flaps project from their respective sidewall segment areas toward the right rather than toward the left as was the case for the FIGS. 2, 3, 4 and 7 embodiment in which the sidewalls were folded upwardly out of the plane of the FIG. 1 blank.

A further attribute of the invention involves the use of indicia on the blank 10. FIG. 1 illustrates a first set of indicia 78 on the visible face of blank 10 as viewed in FIG. 1 and a second set of indicia 80 on the opposite face. The illustrated indicia are in the form of printed information and the two respective sets of indicia 78, 80 provide different information. The example of FIG. 1 shows that the indicia 78 identifies one model, ABC Model, and the indicia 80 another model, XYZ Model. The indicia may be imparted to the blank by any suitable means for example by printing, stenciling or other similar procedure, and in the illustrated embodiment the indicia are applied to opposite sides of the main wall area 12.

When a package component is fabricated from the blank of FIG. 1 by folding the sidewall segment areas downwardly from the plane of the drawing figure (analogous to FIG. 8) the indicia 78 is on the exterior while the indicia 80 is on the interior. When inner and outer packaged halves are fabricated in this way and used to package the ABC Model identified by the indicia 78, the correct identifying indicia for the packaged product model appears on both top and bottom of the package.

If, instead, packaging halves are fabricated by folding the side segment areas upwardly out of the plane of the FIG. 1, (as in FIGS. 2, 3 and 4) the indicia 80 appears on the exterior on the top and bottom of telescoped packaging halves thus formed and correctly identifies an XYZ Model product contained therein. Thus, although the packaging components contain both sets of indicia, the appropriate indicia appears on the exterior while the inappropriate indicia is on the interior where it will not be seen when the two package halves are telescoped together to package the model.

The advantage of this feature is that a single inventory supply of blanks containing both sets of indicia can be used for making both telescoping package halves for two different models of packaged products so that the correct identifying indicia appears on the exterior of the package. This can further simplify inventory and manufacturing requirements. While the example of indicia which is used is seen to comprise printed information, other forms of indicia may be used, such as color coding, etc.

Figure 9:
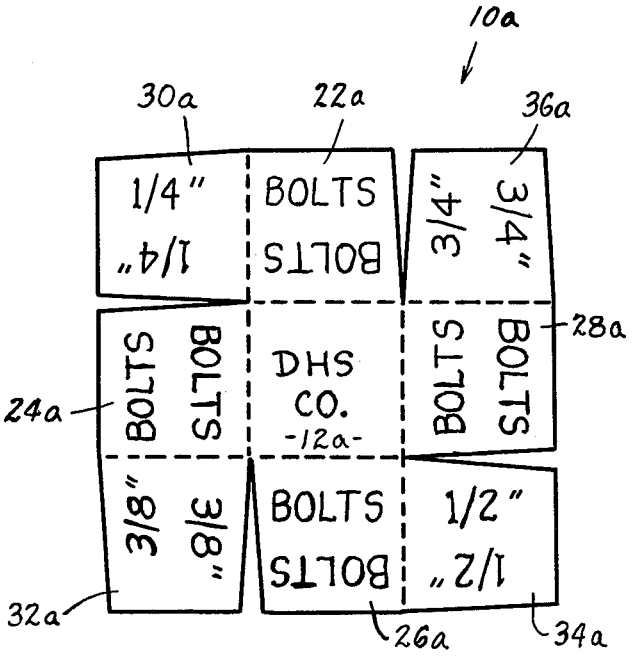
FIG. 9 is a plan view of another package blank embodying principles of the present invention.
Figure 10:
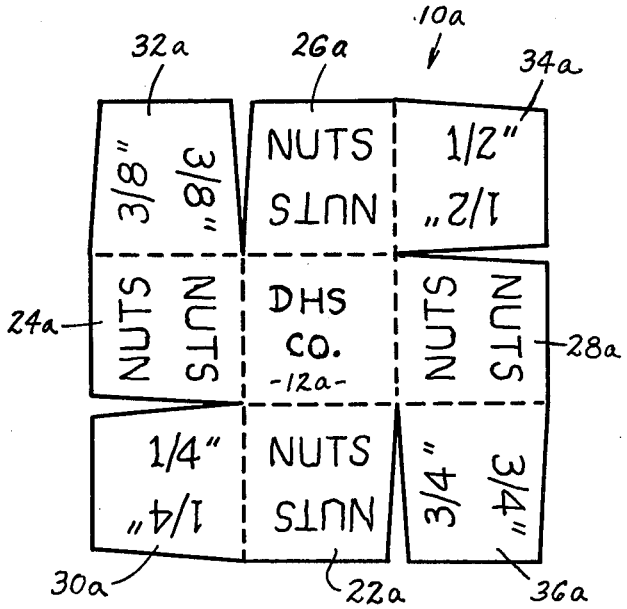
FIG. 10 is a bottom view of the FIG. 9 blank.

FIGS. 9 and 10 illustrate a further application of indicia to a blank which can provide even greater versatility in usage and a further reduction in inventory requirements. As will be seen in the ensuing description it can also provide for improved identification and user convenience.

FIG. 9 illustrates one face of a blank 10a, and FIG. 10 the opposite face. The constituent areas of blank 10a correspond to similar constituent areas of blank 10 in FIG. 1. Hence each constituent area of blank 10*a* is identified by the same base numeral as the corresponding constituent area in FIG. 1 but with the inclusion of the suffix a. Hence blank 10*a* has a main end wall area 12*a*, side segment areas 22*a*, 24*a*, 26*a* and 28*a*, and flap areas 30*a*, 32*a*, 34*a* and 36*a*. The shape of blank 10*a* is such that the main end wall and the sidewall segment areas are substantially identical squares whereby the package component fabricated from the blank will have a generally cubical shape, a shape which could be used to package components such as screws, bolts, nuts, etc. Although such a shape and usage are given as a specific example, it will be appreciated that the inventive features are applicable to other shapes and usages as well.

The flap areas are basically identical and each is substantially of a square shape corresponding to the square shapes of the side segment and the end wall areas although the flap areas do have slight tapers imparted to them similar to blank 10. Consequently, in the fabricated packaging component the flap areas of blank 10*a* overlap virtually the entire side segment areas.

In the fabricated package half the construction of its sidewall therefore comprises two thicknesses of material, each of four sides comprising one of the side segments areas and an overlapping flap area. Because a flap area may be placed on either the exterior or the interior, there are a number of different possible ways to fabricate a package half depending upon which flap or flaps are on the exterior and which on the interior. By appropriately imparting information to the side segment and flap areas, it is possible for a single blank to be used for a number of different packaged products so that appropriate information relative to a packaged product appears on the exterior of the packaging where it may be readily seen by an observer, and so that the inappropriate information does not appear on the exterior. Information in the form of intelligible printed indicia is applied to blank 10*a*, and FIGS. 9 and 10 illustrate an example of such indicia. Principles of the invention apply to other forms of information as well.

The example illustrates how a single blank can be used to package any one of eight different products with appropriate identifying indicia for each being displayed on the exterior of the packaged product. Each side segment area and its adjoining flap area (for example 26*a*, 34*a*) is provided on each of its opposite sides with indicia identifying a particular one of the eight products; hence there are eight such sets of indicia on blank 10*a*. These eight sets of indicia are as follows: ¼" bolts; ⅜" bolts; ½" bolts; ¾" bolts; ¼" nuts; ⅜" nuts; ½" nuts; and ¾" nuts. The printed information is on each side segment-flap face in duplicate such that one will always be rightside up regardless of which way the side segment areas are folded with respect to the main end wall area. In the illustrated embodiment the indicia constituting each set is separated such that one part is provided on the side segment area and the other part on the flap area. Moreover, the separation is such that on each face of the blank the side segment areas each contain information which is generic to the flap information on the same face. The flap area information is unique to a particular product and hence constitutes species information.

Figure 11:
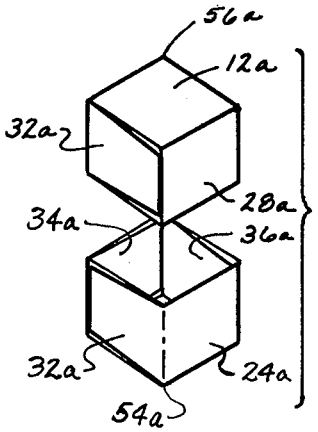
FIG. 11 is a perspective view of one form of packaging fabricated from the FIG. 9 blank, the indicia being omitted.

FIG. 11 illustrates an example in which upper outer telescoping half 56*a* has been fabricated from a blank 10*a*, and a lower inner telescoping half 54*a* has been fabricated from another blank 10*a*. The upper outer telescoping half 56*a* has been fabricated in such a way that only one of the four flap areas (32*a*) is on the exterior with the remaining three flap areas (30*a*, 34*a*, 36*a*) being on the interior. Hence in the fabricated component 56*a* the information which appears on its sidewall comprises the generic information "bolts" on the three side segment areas which are on the exterior (22*a*, 24*a*, 28*a*) while the species information ⅜" appears on the remainder because the flap 32*a* has been placed on the exterior.

The lower inner half 54*a* has been fabricated in an analogous manner so that only one of the flaps is on the exterior, namely the ⅜" flap 32*a*; the remaining three sides of the lower half have the generic information "bolts" visible on the exterior. When ⅜" bolts are packaged in the lower package half and it is then closed by the upper package half, the information presented on the side of the upper package half provides accurate information relative to the contents, and the other information which would not be appropriate is not seen. Similarly when the user removes the upper package half, accurate information, both generic and species, is provided on the exterior sidewall of the lower half. By printing the information in duplicate upside down as well as rightside up the information may be conveniently read, both with the upper half telescoped over the lower half and on the lower half as well when the upper half has been removed. If one is not concerned about the information which actually appears on the exterior of the lower package half (for example where the outer half fully telescopes onto the lower half and therefore covers the sidewall of the lower half), then the manner of fabrication of the lower half may be done without regard to whether flaps are on the interior or exterior. However, it is believed that the illustrated fabrication will be preferred so that after the package has been open, the lower half continues to display the correct information relative to its contents.

With this description in mind it should be apparent that for the same direction of side segment folding relative to main area 12*a* as in FIG. 11, any one of the four flaps may be placed on the exterior of an outer package half and the remaining three on the interior whereby blank 10*a* can provide the upper package half for any of four different types of packaged products depending upon which flap is on the exterior. The lower half may be constructed in an analogous manner to that explained for 54. This then covers packaging for four different products namely ¼" bolts; ⅜" bolts, ½" bolts; and ¾" bolts, of the example. The remaining four are developed by folding side segment areas in the opposite direction as will be subsequently explained in connection with FIG. 12.

It should also be pointed out at this juncture that both generic and species identification could be provided entirely on the flaps alone rather than the generic information being on the side segment areas and the species information on the flap areas as illustrated in the drawing figure as one specific example. It is also possible for the information which is utilized to identify the packaged product to take the form of other than printed intelligible information, and for this purpose other identification indicia such as different colors, UPC bar codes, etc., might be used. The example also shows that the end wall 12*a* can comprise information which is generic to the information on the side segment areas and flap areas. For example, it could identify the manufacturer of the product.

Figure 12:
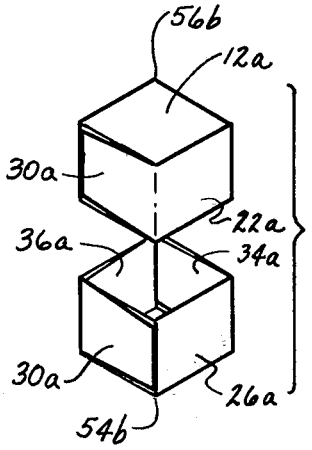
FIG. 12 is a perspective view of another form of packaging fabricated from the FIG. 9 blank, the indicia being omitted.

FIG. 12 illustrates an example of packaging for one of the four remaining packaged products which can be packaged with the use of blank 10*a*. The upper outer package half is identified by the numeral 56*b* and the lower inner half by the numeral 54*b*. The example illustrates that the package has been fabricated for ¼" nuts, the example being exactly analogous to that of FIG. 11. The principles involved in fabricating the packaging into the other configurations for ⅜" nuts; ½" nuts and ¾" nuts are also directly analogous to those explained in connection with the FIGS. 9 and 11 example.

While the example of FIG. 9 has shown the flaps to contain species information relative to the respective packaged products, it would be possible to have that information on the side segment areas instead and for the flap areas to be disposed such that for a given packaged product the appropriate side segment area has the overlapping flap on the interior and the other side segment areas are covered on their exterior by the other flaps. The flap areas would then contain the generic information.

Variations may be indulged in with respect to various dimensions and shapes, and by way of example reference is made to the flaps and the cuts. The drawings show tapered flaps and V-shaped cuts by way of illustrating principles of the invention. Different tapers may be used and different V-shapes may be used, and other than tapers and V-shapes may be used within the scope of the invention. The illustrations also show the blanks to be imperforate; if appropriate, perforations could be incorporated, for example where some ventilation of the interior is desired. Furthermore, the perforations need not be identically arranged in upper and lower package halves, and the shapes of the perforations may be varied. The illustrations also show rectangular shaped and cubical shaped packaging components, and principles of the invention are applicable to other than four-sided constructions. Various materials other than those disclosed may be used to make the components. Various means for securing the flaps to the immediately sidewall segments may be used, for example, staples, adhesives, tapes, etc.

The foregoing discloses a new and improved packaging construction. While a preferred embodiment has been disclosed, it will be appreciated that principles of the invention are applicable to other embodiments.

What is claimed is:

1. Packaging comprising two package halves telescopically engaged, each half comprising a main end wall and a sidewall, said halves being fabricated from flat blanks having congruent perimeters, each half having a set of boundary lines defining the perimeter of its main end wall, the sets of boundary lines of the two halves being congruent, each half having its own sidewall folded about its own main end wall's set of boundary lines, each sidewall comprising sidewall segments meeting at corners, said sidewall segments joining together at each corner by means of a flap integral with a sidewall segment and overlapping and secured to an adjacent sidewall segment, the nature of the telescopic engagement of the two halves being such that all corners of one of said two halves are disposed within the interior of the other of said halves, the telescopic engagement being provided by the flaps of said one half having a greater amount of overlap with the adjacent sidewall segments which they overlap and are secured to than do the flaps of said other half with the adjacent sidewall segments which they overlap and are secured to.

2. Packaging as set forth in claim 1 in which each set of boundary lines comprises lines of scoring in the blank about which the corresponding sidewall is folded with respect to the corresponding main end wall, and including score lines in each blank by which said flaps thereof integrally join with their respective sidewall segments, said flaps of each half being folded with respect to their respective sidewall segments about said last-mentioned score lines.

3. Packaging as set forth in claim 2 in which said score lines in each blank by which said flaps thereof integrally join with their respective sidewall segments comprise, for each flap and the corresponding side wall segment with which it integrally joins, a pair of score lines diverging away from the corresponding main end wall.

4. Packaging as set forth in claim 1 in which each main end wall is of a rectangular shape, each sidewall segment is of a substantially rectangular shape, there being four sidewall segments for each half, and each half contains four flaps, each of which integrally joins with a different one of the side wall segments, the flaps of each blank projecting away from the sidewall segments with which they integrally join in the same sense around the blank.

5. Packaging as set forth in claim 4 wherein each blank has a V-shaped notch separating each flap from the adjacent sidewall segment with and to which it is to be overlapped and secured, each V-shaped notch having both its sides non-parallel in the blank to the corresponding main end wall's set of boundary lines.

6. Packaging as set forth in claim 4 in which all four flaps of each half are disposed on the interior of the half when overlapping and secured to their corresponding adjacent sidewall segments.

7. Packaging as set forth in claim 6 in which each flap has a tapering shape which narrows in the direction away from the sidewall segment with which it integrally joins, each flap integrally joining with the corresponding sidewall segment along a line of folding, the taper of each flap being provided by side edges which project away from the fold line via which the flap joins with the corresponding sidewall segment at angles which are not perpendicular to the fold line, one of said side edges of each flap being disposed nearer the corresponding main end wall than the other side edge of the same flap, said one side edge of each of said flaps of said one half being disposed more substantially in parallel with the main end wall of said one half than the other side edge of the same flap when overlapping and secured to the corresponding adjacent sidewall segment, and said other side edge of each of said flaps of said other half being disposed more substantially in parallel with the main end wall of said other half than said one side edge of the same flap when overlapping and secured to the corresponding adjacent sidewall segment.

8. Packaging as set forth in claim 1 in which each blank has one set of indicia on one face and another set of indicia different from said one set of indicia on the opposite face, each blank being formed into its corresponding half such that said one set of indicia is on the exterior of the packaging and said another set of indicia is on the interior of the packaging.

9. Packaging as set forth in claim 1 for a particular packaged product to be contained within said two telescopically engaged package halves, indicia on selected faces of the flaps of at least one of said two package halves with some of said flaps of said at least one package half being disposed on the interior of that half and at least one of said flaps of said at least one package half being disposed on the exterior of that package half, the exterior face of said at least one flap of said at least one package half which is disposed on the exterior of that half containing indicia related to the particular product and at least one of the interiorly disposed flaps of said at least one package half containing indicia related to a product other than the particular product.

10. Packaging as set forth in claim 1 in which a set of indicia is disposed on each face of pre-defined portions of each blank, each sidewall segment and integrally adjoining flap constituting a corresponding one of said predefined portions with each such set of indicia identifying a different product which can be packaged within said packaging.

11. Packaging as set forth in claim 10 wherein each set of indicia is divided into one part which is disposed on the corresponding side segment and another part which is disposed on the corresponding flap.

12. Packaging as set forth in claim 10 wherein each set of indicia is divided into one part which is disposed on the corresponding side segment and another part which is disposed on the corresponding flap.

13. Packaging comprising two package halves telescopically engaged, each half comprising a main end wall and a sidewall, said halves being fabricated from flat blanks, each half having a set of boundary lines defining the perimeter of its main end wall, said sets of boundary lines of the two halves being congruent, each half having its own sidewall folded about its own main end wall's set of boundary lines, each sidewall comprising sidewall segments meeting at corners, each sidewall segment having a flap integrally joining therewith, said sidewall segments joining together at each corner by means of said flaps overlapping and secured to an adjacent sidewall segment, the nature of the telescopic engagement of the two halves being such that all corners of one of said two halves are disposed interiorly of the corners of the other of said halves, the telescopic engagement being provided by the flaps of said one half having a greater amount of overlap with the adjacent sidewall segments which they overlap and are secured to than do the flaps of said other half with the adjacent sidewall segments which they overlap and are secured to, said halves telescopically fitting together such that each corner of the telescoped halves comprises a flap of said one half at one side of the corner and a flap of the other half at the other side of the corner.

14. Packaging as set forth in claim 13 wherein said blanks have congruent perimeters.

15. Packaging as set forth in claim 13 in which each set of boundary lines comprises lines of scoring in the blank about which the corresponding sidewall is folded with respect to the corresponding main end wall, and including score lines in each blank by which said flaps thereof integrally join with their respective sidewall segments, said flaps of each half being folded with respect to their respective sidewall segments about said last-mentioned score lines.

16. Packaging as set forth in claim 15 in which said score lines in each blank by which said flaps thereof integrally join with their respective sidewall segments comprise, for each flap and the corresponding sidewall segment with which it integrally joins, a pair of score lines diverging away from the corresponding main end wall.

17. Packaging as set forth in claim 13 wherein each blank has a V-shaped notch separating each flap from the adjacent sidewall segment with and to which it is to be overlapped and secured, each V-shaped notch having both its sides non-parallel in the blank to the corresponding main end wall's set of boundary lines.

18. Packaging as set forth in claim 13 in which each flap has a tapering shape which narrows in the direction away from the sidewall segment with which it integrally joins, each flap integrally joining with the corresponding sidewall segment along a line of folding, the taper of each flap being provided by side edges which project away from the fold line via which the flap joins with the corresponding sidewall segment at angles which are not perpendicular to the fold line, one of said side edges of each flap being disposed nearer the corresponding main end wall than the other side edge of the same flap, said one side edge of each of said flaps of said one half being disposed more substantially in parallel with the main end wall of said one half than the other side edge of the same flap when overlapping and secured to the corresponding adjacent sidewall segment, and said other side edge of each of said flaps of said other half being disposed more substantially in parallel with the main end wall of said other half than said one side edge of the same flap when overlapping and secured to the corresponding adjacent sidewall segment.

19. Packaging as set forth in claim 13 in which each blank has one set of indicia on one face and another set of indicia different from said one set of indicia on the opposite face, each blank being formed into its corresponding half such that said one set of indicia is on the exterior of the packaging and said another set of indicia is on the interior of the packaging.

20. Packaging as set forth in claim 13 for a particular packaged product to be contained within said two telescopically engaged package halves, indicia on selected faces of the flaps of at least one of said two package halves with some of said flaps of said at least one package half being disposed on the interior of that half and at least one of said flaps of said at least one package half being disposed on the exterior of that package half, the exterior face of said at least one flap of said at least one package half which is disposed on the exterior of that half containing indicia related to the particular product and at least one of the interiorly disposed flaps of said at least one package half containing indicia related to a product other than the particular product.

21. Packaging as set forth in claim 13 in which a set of indicia is disposed on each face of pre-defined portions of each blank, each sidewall segment and integrally adjoining flap constituting a corresponding one of said predefined portions with each such set of indicia identifying a different product which can be packaged within said packaging.

* * * * *